US006938761B2

(12) United States Patent
Nish

(10) Patent No.: US 6,938,761 B2
(45) Date of Patent: Sep. 6, 2005

(54) SPORTSMEN'S UTILITY BUCKET COVER APPARATUS AND METHOD

(75) Inventor: Jeffery Lynn Nish, Centerville, UT (US)

(73) Assignee: J&M Innovative Products, LLC, Woods Cross, UT (US)

( * ) Notice: Subject to any disclaimer, the term of this patent is extended or adjusted under 35 U.S.C. 154(b) by 155 days.

(21) Appl. No.: 10/458,014

(22) Filed: Jun. 10, 2003

(65) Prior Publication Data

US 2005/0011785 A1 Jan. 20, 2005

(51) Int. Cl.[7] ..... A45F 3/04; B65D 85/00

(52) U.S. Cl. ..... 206/315.11; 224/629; 224/650; 224/652; 224/653

(58) Field of Search ..... 206/315.11, 349, 206/373; 224/629, 630, 650, 652, 653

(56) References Cited

U.S. PATENT DOCUMENTS 3,221,959 A * 12/1965 Southwick
4,353,182 A * 10/1982 Junkas et al. ..... 43/54.1
5,174,447 A * 12/1992 Fleming ..... 206/373
5,429,265 A * 7/1995 Maire et al. ..... 220/522
5,462,213 A * 10/1995 Watt ..... 224/155
5,595,429 A * 1/1997 Kennedy ..... 312/235.2
5,833,095 A * 11/1998 Russell et al. ..... 224/576
6,029,877 A * 2/2000 Woods ..... 224/652
6,315,310 B1 * 11/2001 Hurt ..... 280/79.5
6,536,590 B1 * 3/2003 Godshaw et al. ..... 206/373

* cited by examiner

*Primary Examiner*—John A. Ricci
(74) *Attorney, Agent, or Firm*—Holland & Hart

(57) ABSTRACT

A sportsmen's utility bucket cover is provided for use in combination with a standard utility bucket. The cover includes a cylindrical wall that surrounds the outside cylindrical surface of the bucket. The cover also includes a bottom wall that is configured to correspond to the closed end of the utility bucket. A foam pad may be inserted between the bottom wall of the cover and the closed end of the bucket for seat cushioning purposes. The cover still further comprises a plurality of pockets and a beverage holder formed on the outside of the utility bucket cover to hold any desired item. Each pocket includes a closure facing toward the closed end of the bucket so that when the bucket is used as a seat, the pocket openings face upward, allowing the sportsman to access the pockets yet prevent the contents from spilling onto the ground.

5 Claims, 2 Drawing Sheets

SPORTSMEN'S UTILITY BUCKET COVER APPARATUS AND METHOD

FIELD OF THE INVENTION

This invention relates to utility buckets used by sportsmen. More particularly, this invention relates to covers for utility buckets used by sportsmen.

BACKGROUND OF THE INVENTION

Covers for utility buckets have existed for some time. One traditional use of a utility bucket cover is to allow a handyman to store and access tools more readily. Most traditional utility bucket covers are secured over the outside wall of the utility bucket so that tools and other implements can be stored inside the bucket, while various pockets and other receptacles provided on the cover will hold additional tools and implements on the outside of the bucket.

Sportsmen have traditionally used utility buckets in the field. For example, ice fishermen have traditionally carried their equipment and gear inside of the utility bucket. When a fisherman arrives at his or her preferred fishing destination, the fisherman empties the contents of the bucket, inverts the bucket, and sits on top of the bucket while he or she fishes. Thus, the bucket serves the dual purpose of carrying equipment and providing a seat once in the field.

There are problems associated with utilizing traditional utility bucket covers on utility buckets to carry implements and to use as a seat while fishing. If items are placed inside of the pockets of a traditional utility bucket cover, as soon as the bucket is inverted for seating purposes, the contents of the pockets will fall out.

Another problem associated with traditional utility bucket covers is that there is no padding or protection when the bucket is used as a seat. When inverting a traditional bucket for seating purposes, only the hard plastic bottom surface of the bucket is available for the sportsman to sit on. Even if a traditional utility bucket cover is used, when the bucket is inverted only the hard plastic bottom surface is exposed for seating.

Yet another problem associated with traditional sportsmen utility buckets relates to the difficulty in carrying the bucket. While carrying a utility bucket by the standard utility bucket handle is certainly manageable for short periods, extended trips are more difficult. Furthermore, carrying the bucket by the handle requires use of at least one arm and hand.

The foregoing problems associated with traditional utility bucket covers gives rise to a need for an improved utility bucket cover for use by sportsmen. Specifically, there is a need to develop a sportsmen's utility bucket cover that provides a convenient, padded seat, that allows implements utilized by a sportsman to be carried in the main compartment of the bucket, that allows items to be stored in pockets formed in the cover such that the items can be accessed by the sportsman while sitting on the bucket, and that is easier to carry for extended periods.

SUMMARY OF THE INVENTION

The present invention relates to a sportsmen's utility bucket cover comprising generally a cylindrical body sized for positioning around the outside cylindrical wall of a standard utility bucket. The utility bucket cover further comprises a cushioning member attached to the cylindrical body to coincide with the bottom surface of the bucket so that when the bucket is inverted the cushioning device will act as a pad for seating purposes. The utility bucket cover of the present invention also comprises a plurality of pockets with openings that face toward the closed end of the bucket so that when the bucket is used as a seat, the pockets open upward toward the sportsman seated on the bucket. Still further, the sportsmen's utility bucket cover includes a pair of backpacking straps to facilitate carrying the sportsmen's utility bucket to and from the field for extended trips.

The foregoing and other features, utilities, and advantages of the invention will be apparent from the following detailed description of the invention with reference to the accompanying drawings.

DETAILED DESCRIPTION OF THE INVENTION

Figure 1:
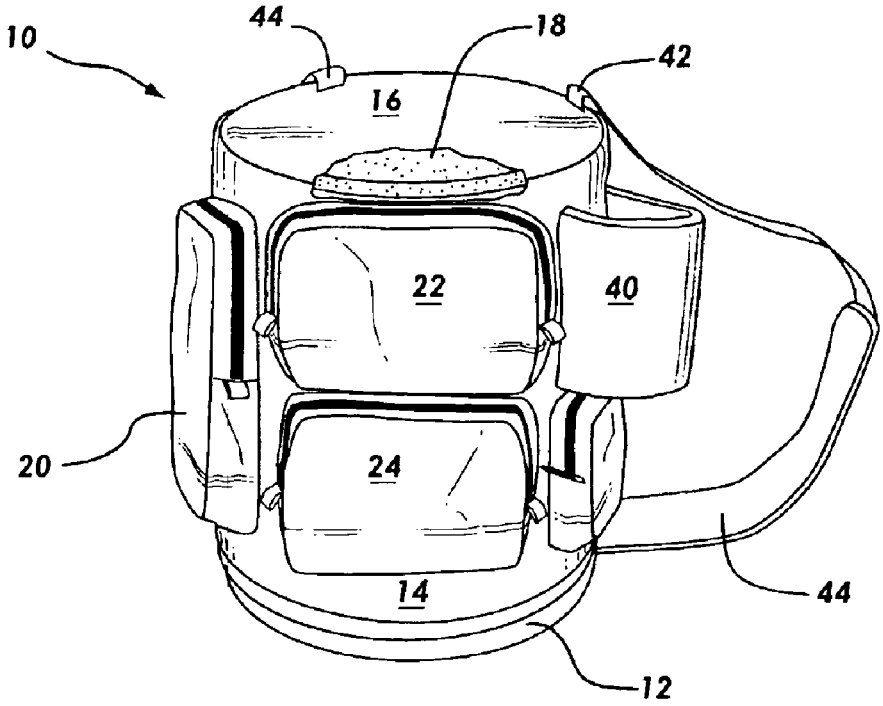
FIG. 1 is a perspective view of a sportsmen's utility bucket cover secured to a conventional utility bucket with the utility bucket being inverted for seating purposes according to the present invention.

FIG. 1 shows a sportsmen's utility bucket cover 10 secured about a conventional utility bucket 12. The utility bucket 12 may be a standard five gallon utility bucket, although the invention can be sized to fit any size of utility bucket.

As shown in FIG. 1, the utility bucket cover 10 is configured and sized to be inserted over a utility bucket 12 (the bucket 12 is shown inverted in FIG. 1). The cover 10 includes a cylindrical wall or panel 14 which extends around the outside cylindrical surface of the bucket 12. The cover 10 further includes a bottom wall 16 which is inserted over the closed end (not shown) of the bucket 12. In the embodiment of FIG. 1, a cushioning device, such as a foam pad 18, is disposed between the bottom wall 16 of the cover 10 and the closed end (not shown) of the utility bucket 12. Alternatively, the foam pad may be enclosed between two bottom wall panels formed in the utility bucket cover 10. The cushioning pad 18 provides comfort and protection for the sportsman when utilizing the utility cover in combination with the bucket for seating purposes.

The cover further includes a plurality of pockets 20, 22, 24, 26, 28 for holding various items that a sportsman may need while in the field. For example, a fisherman could store, without limitation, hooks, line, sinkers, lures, bait, stringers, and any other fishing accessory in the pockets where appropriate. Although various pockets (both in terms of number and size) are shown in the drawings, those skilled in the art will understand that the number and size of the pockets may vary without departing from the scope of the present invention.

Figure 4:
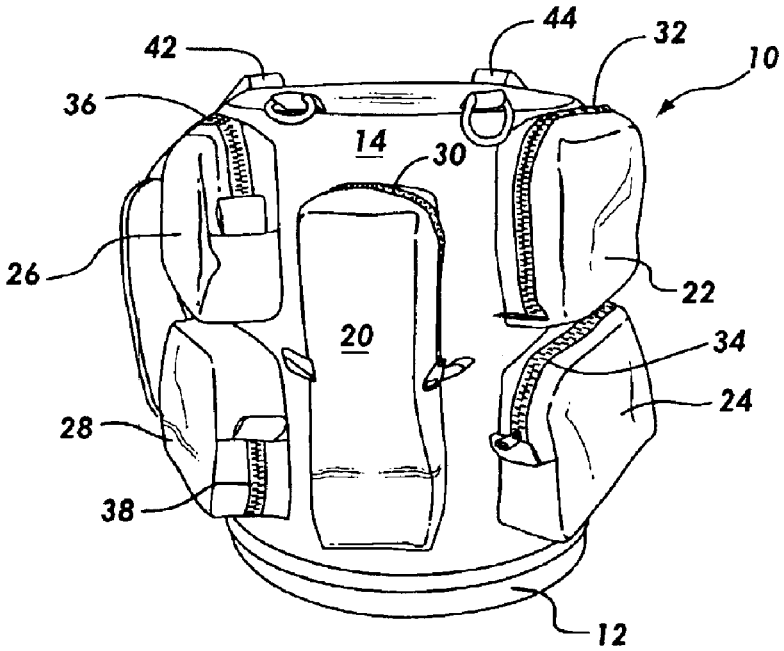
FIG. 4 is a left side view of a sportsmen's utility bucket cover placed over a utility bucket according to the present invention.

Each pocket includes a closure (closures 30, 32, 34, 36, 38, respectively, shown in FIG. 4), all of which may be oriented such that they open in a direction facing the closed end of the bucket (closures 30, 32, 34, 36 are shown facing toward the closed end of the bucket). Alternatively, the closures may each open in a direction facing toward the open end of the bucket (pocket 28 and closure 38 is shown facing toward the open end of bucket). Any combination of the above-described orientations of pockets/closures may be used without departing form the scope of the present invention. The embodiment shown in the drawings utilizes zippers as closures. It is to be understood, however, that other closure members known to those skilled in the art could be used. Pockets oriented to open toward the closed end of the bucket will not allow items to fall out of the pockets when the bucket 12, including the cover 10, is positioned for seating purposes, while opening of the pockets would allow access into the pockets.

The cover 10 further comprises a beverage holder 40 (FIGS. 1 and 3) sized to hold a beverage container 42 (FIG. 3) to be accessible to the sportsman when using the utility bucket and cover. The beverage holder is sized to hold a typical 12 oz. can and is preferably made of insulating material. As those skilled in the art will understand, however, other sizes of beverage holders may be provided.

Figure 2:
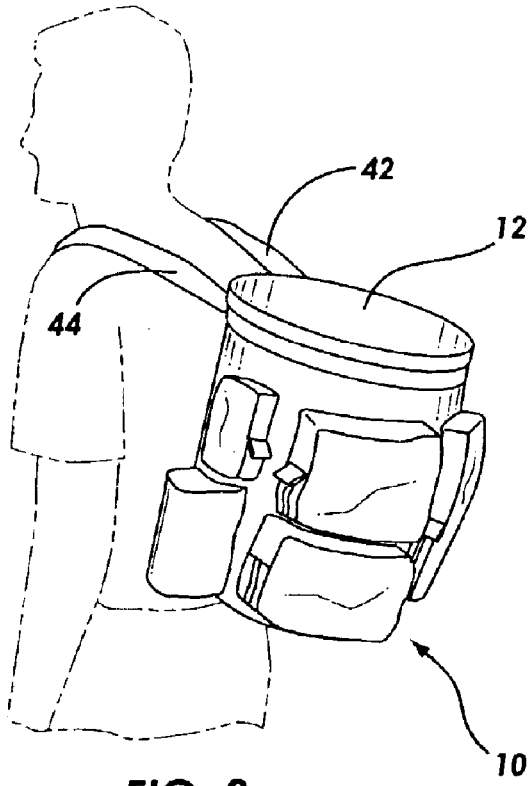
FIG. 2 is a perspective view of the combined sportsmen's utility bucket cover, according to the present invention, and conventional bucket being carried by a person (shown in phantom)

The utility bucket cover still further comprises a pair of backpacking-type straps 42, 44 which allow the person utilizing the combined sportsmen's bucket 12 utility cover 10 to fill the main compartment of the bucket 12 (FIG. 2) and carry the loaded-up bucket into the field, or on other extended trips, as shown in FIG. 2. The backpacking straps 42, 44 may be conventional backpacking straps. A chest strap may be utilized, similar to chest straps used for backpacks.

To secure the utility bucket cover 10 around the utility bucket 12, the cover is slid or positioned over the outside, cylindrical surface of the bucket with the bottom wall 16 of the cover 10 coinciding with the closed end of the bucket (not shown). The cylindrical wall portion 14 extends around the cylindrical outside surface of the bucket 12. An elastic strap, or other fastener, may be variably lengthened or shortened to accommodate the outside diameter of the bucket, yet pull the sides of the cylindrical wall 14 of the utility bucket cover 10 closely against the outer wall of the bucket 12. After the cover 10 has been completely inserted over the bucket 12, a fastening strap may be used to further secure the cover 10 about the bucket 12 adjacent the open end of the bucket.

Figure 3:
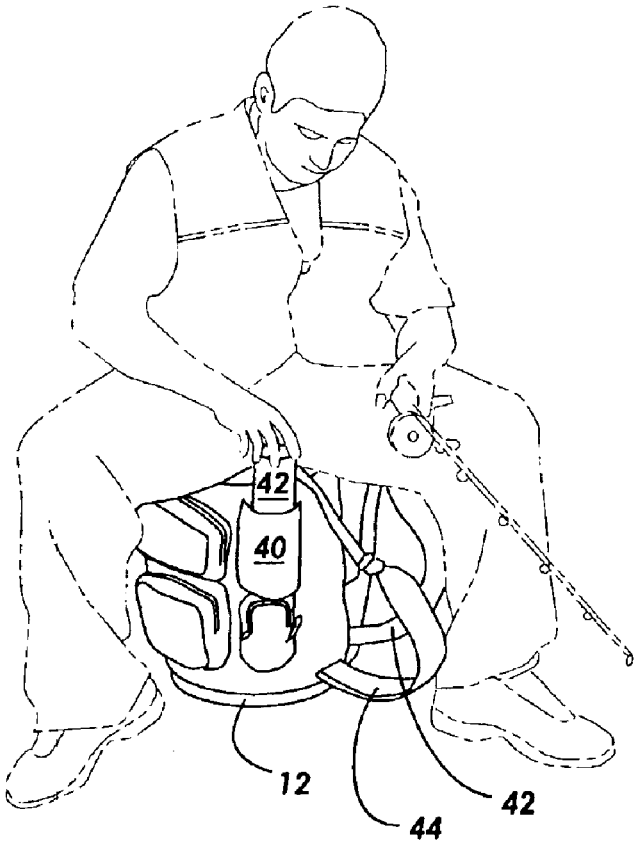
FIG. 3 is a perspective view of the combined sportsmen's utility bucket cover, according to the present invention, and conventional utility bucket being utilized by a fisherman (shown in phantom)

In operation, a utility bucket cover 10 is used to cover and envelope a standard utility bucket 12, as shown in FIG. 1. Utility bucket cover 10 secures a foam pad 18 between the bottom wall 16 of the utility bucket cover at the closed end (not shown) of the bucket 12 so that the user can be comforted when sitting on the closed end of the bucket. When transporting materials to the field, the utility bucket 12 and cover 10 combination is used as a backpack, with the open end of bucket 12 facing upward (as shown in FIG. 2). The main compartment of the bucket can be filled through the open end with items desired by the outdoorsman. Once the sportsman arrives at a desired destination, such as a preferred location on top of a frozen body of water for ice fishing, the contents of the main compartment are removed and the bucket is inverted with the open end of the bucket being placed on the ground so that the sportsman can sit on top of the bucket and have the foam pad 18 (FIG. 1) cushion the seat, as shown in FIG. 3. The pockets 20–26, which include closures, may be opened so that each pocket opening faces upward, allowing access yet preventing the contents of the plurality of pockets from spilling on the ground. Alternatively, one or more of the pockets (such as pocket 28 is shown) may have closures that face toward the open end of the bucket and can be accessed when loading and unloading the bucket. After the user is done utilizing the combination sportsmen's utility bucket cover 10 and utility bucket 12, the items can be placed, once again, into the main compartment through the open end of the bucket and the user can place the backpacking straps around his or her shoulders to carry the bucket away from the field.

While this invention has been described with reference to certain specific embodiments and examples, it will be recognized by those skilled in the art that many variations are possible without departing from the scope and spirit of this invention. The invention, as defined by the claims, is intended to cover all changes and modifications of the invention which do not depart from the spirit of the invention. The words "including" and "having," as used in the specification, including the claims, shall have the same meaning as the word "comprising."

What is claimed is:

1. A cover for a utility bucket, comprising:

a cover to be held by a utility bucket, the utility bucket comprising a bottom wall, a cylindrical wall extending upwardly from the bottom wall, and an open end defined by the cylinder opposite the bottom wall;

the cover extending around at least a portion of the cylindrical wall of the utility bucket;

at least one pocket formed in the cover, the pocket having an opening facing a direction opposite the open end of the bucket;

wherein the cover extends around the bottom wall of the utility bucket, and further comprising a cushioning pad disposed between the cover and the bottom wall of the bucket.

2. A cover for a utility bucket, comprising:

a cover to be held by a utility bucket, the utility bucket comprising a bottom wall, a cylindrical wall extending upwardly from the bottom wall, and an open end defined by the cylinder opposite the bottom wall;

the cover extending around at least the bottom wall of the cylindrical wall of the utility bucket;

a cushioning pad disposed between the cover and the bottom wall of the bucket.

3. A cover for a utility bucket according to claim 2 wherein the cover extends over a portion of the cylindrical wall of the utility bucket, and further comprising at least one pocket formed in the cover, the pocket having an opening facing a direction opposite the open end of the bucket.

4. A cover for a utility bucket according to claim 2 wherein the cover extends over a portion of the cylindrical wall of the utility bucket, and further comprising a plurality of pockets formed in the cover, each pocket having an opening facing a direction opposite the open end of the bucket.

5. A cover for a utility bucket according to claim 2 wherein the cover extends over a portion of the cylindrical wall of the utility bucket, and further comprising a plurality of pockets formed in the cover, each pocket having an opening facing a direction opposite the open end of the bucket, and further comprising a closure associated with each pocket to maintain the pocket in a closed position.

* * * * *